United States Patent [19]

Kasper

[11] Patent Number: 4,485,518

[45] Date of Patent: Dec. 4, 1984

[54] WET-DRY VACUUM CLEANING APPARATUS

[75] Inventor: Gary A. Kasper, Cadillac, Mich.

[73] Assignee: Rexair, Inc., Troy, Mich.

[21] Appl. No.: 510,019

[22] Filed: Jul. 1, 1983

[51] Int. Cl.[3] ..... A47L 7/00; A47L 11/34

[52] U.S. Cl. ..... 15/322; 15/339

[58] Field of Search ..... 15/321, 322, 339

[56] References Cited

U.S. PATENT DOCUMENTS

| | | | |
|---|---|---|---|
| 3,747,155 | 7/1973 | Koellisch | 15/322 |
| 3,896,521 | 7/1975 | Parise | 15/321 |
| 3,974,541 | 8/1976 | Silvis et al. | 15/322 X |
| 4,114,229 | 9/1978 | Jones et al. | 15/320 |
| 4,226,000 | 10/1980 | Tribolet | 15/321 |
| 4,333,203 | 6/1982 | Yonkers | 15/321 |

*Primary Examiner*—Chris K. Moore

*Attorney, Agent, or Firm*—Seidel, Gonda & Goldhammer

[57] ABSTRACT

A wet-dry vacuum cleaning apparatus having a vacuum tube and a head supporting a discharge nozzle at one end of the tube. An assembly is attached to the tube and includes a valve for controlling flow of liquid to the nozzle. The assembly includes a container for detergent adapted to selectively mix with water upstream of the valve. The assembly includes a device for permitting selective introduction of water into said container.

12 Claims, 8 Drawing Figures

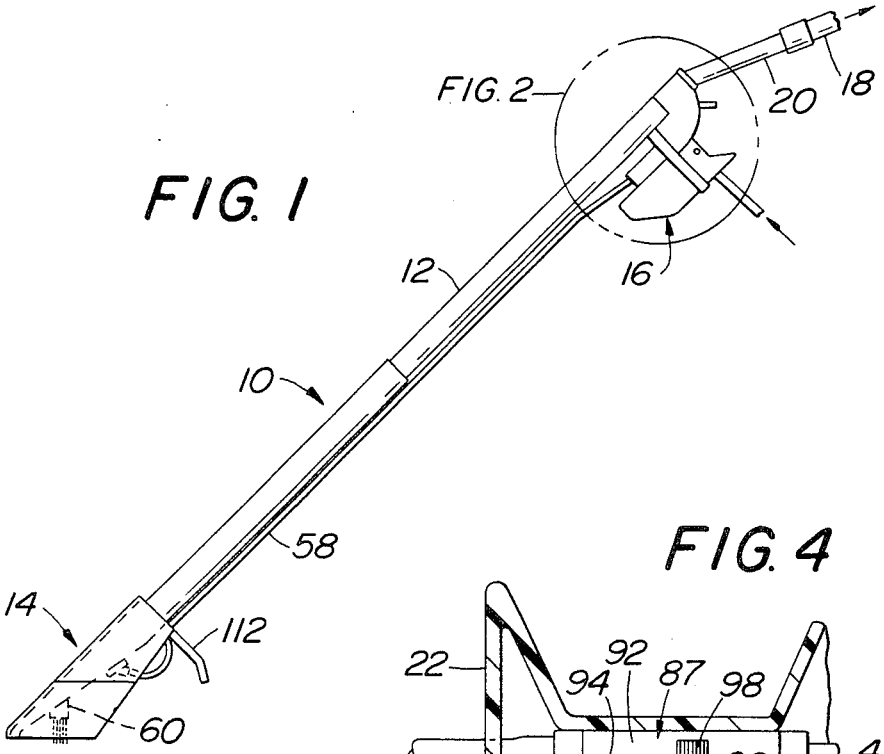
FIG. 1
FIG. 4
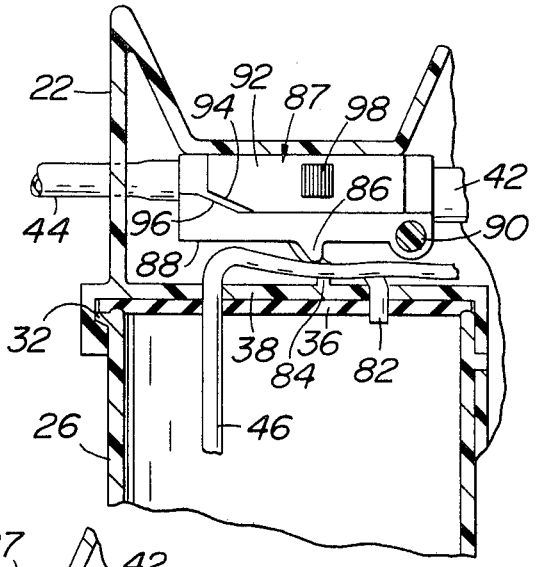
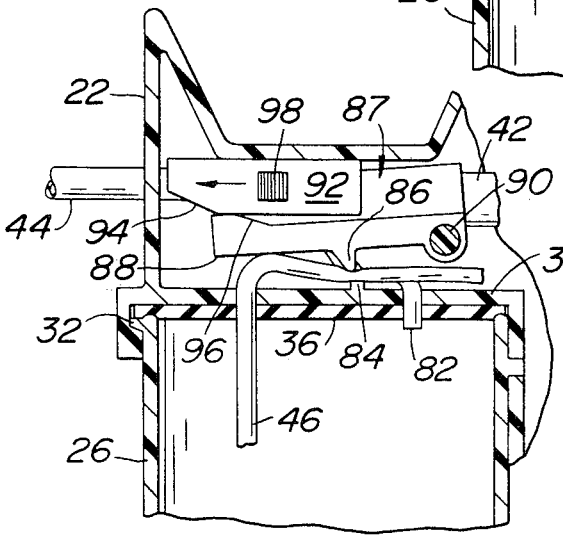
FIG. 5

20
70
68
66
65
69
67
54
3
24
63
114
22
48
42
80
43
56
44
62
64
3
38
32
46
82
84
36
30
34
33
28
26
12
46
58
40
16

WET-DRY VACUUM CLEANING APPARATUS

BACKGROUND

Wet-dry vacuum cleaning apparatus is per se known. Apparatus of the general type involved herein is disclosed in U.S. Pat. No. 4,333,203. The apparatus as disclosed in said patent suffers from several drawbacks.

In the apparatus disclosed in said patent, there is provided a container for introducing detergent or other liquids into the flowing stream of water before discharge through a nozzle. The container is partially filled with a liquid such as detergent and thereafter the remainder of the container is filled with water. In connection with the apparatus as disclosed in said patent, the mixture of water and detergent must be accomplished at some distance from the apparatus and then attached to the apparatus without spilling the mixture. When the mixture has been totally consumed, it is necessary to disconnect the container and find a faucet for more water before cleaning may continue. These features are a disadvantage.

In the apparatus as disclosed in said patent, detergent is introduced into the water lines so long as water is flowing in the water line. There are occasions where it is desired not to introduce detergent into the water line but at the same time permit water to flow through the water line. The inability to selectively permit introduction of detergent in the water line is a disadvantage of the apparatus disclosed in said patent.

It is desirable to make the front face of the head from a transparent material such as a polymer plastic. As a result thereof, the user may judge the effectiveness of the apparatus by the color of the water being sucked into the vacuum tube. It is known to removably attach the transparent face plate with a plurality of bolts or screws. If the water is dirty, it leaves a film on the inner surface of the front face which in turn detracts from the advantage to the user on the next occasion. Hence, there is a need to have a transparent front plate on the head which is easily removable for cleaning without the necessity of tools.

The present invention is directed to a solution of the above-mentioned problems and disadvantages of the prior art.

SUMMARY OF THE INVENTION

The present invention is directed to a wet-dry vacuum cleaning apparatus which includes a hollow vacuum tube having a head at one end. A discharge nozzle is supported by said head. An assembly is attached to the tube. The assembly includes a valve having an inlet conduit and a container. An outlet conduit is connected between the valve and said nozzle.

A means is provided for causing liquid to flow into said inlet conduit from said container for mixing with water upstream of the valve. A means is provided for selectively permitting water to flow from said conduit into said container while the container is supported by the assembly.

It is an object of the present invention to provide a novel wet-dry vacuum cleaning apparatus which overcomes disadvantages of the prior art in a manner which is simple, inexpensive, and reliable.

Other advantages and objects of the present invention will appear hereinafter.

For the purpose of illustrating the invention, there is shown in the drawings a form which is presently preferred; it being understood, however, that this invention is not limited to the precise arrangements and instrumentalities shown.

FIG. 1 is an elevation view of apparatus in accordance with the present invention.

FIG. 4 is a sectional view taken along the line 4—4 in FIG. 3.

FIG. 5 is a view similar to FIG. 4 but showning the components in another position.

SUMMARY OF THE INVENTION

Figure 2:
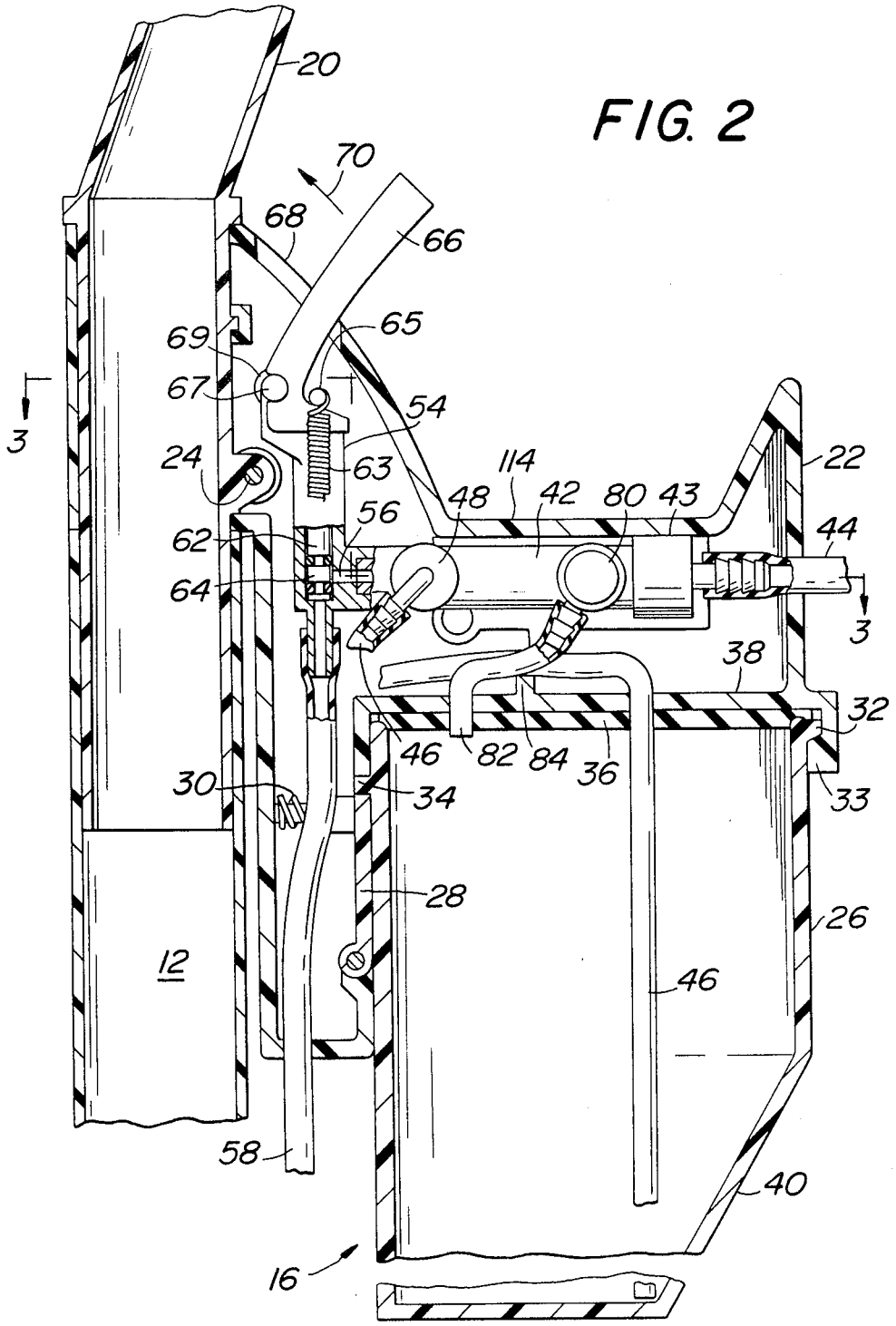
FIG. 2 is a sectional view of the assembly encircled at the upper end of FIG. 1.

Referring to the drawings in detail, wherein like numerals indicate like elements, there is shown in FIG. 1 apparatus in accordance with the present invention and designated generally as 10. The apparatus 10 includes a vacuum tube 12 which is preferably comprised of telescoped portions. At the lower end of the tube 12, there is provided a head 14. At the upper end of the tube 12, there is provided an assembly designated generally as 16. At the upper end of the tube 12, there is provided a tube 20 containing an angled portion connected to one end of a flexible vacuum hose 18. The other end of hose 18 is connected to a source of vacuum which may be conventional.

Figure 3:
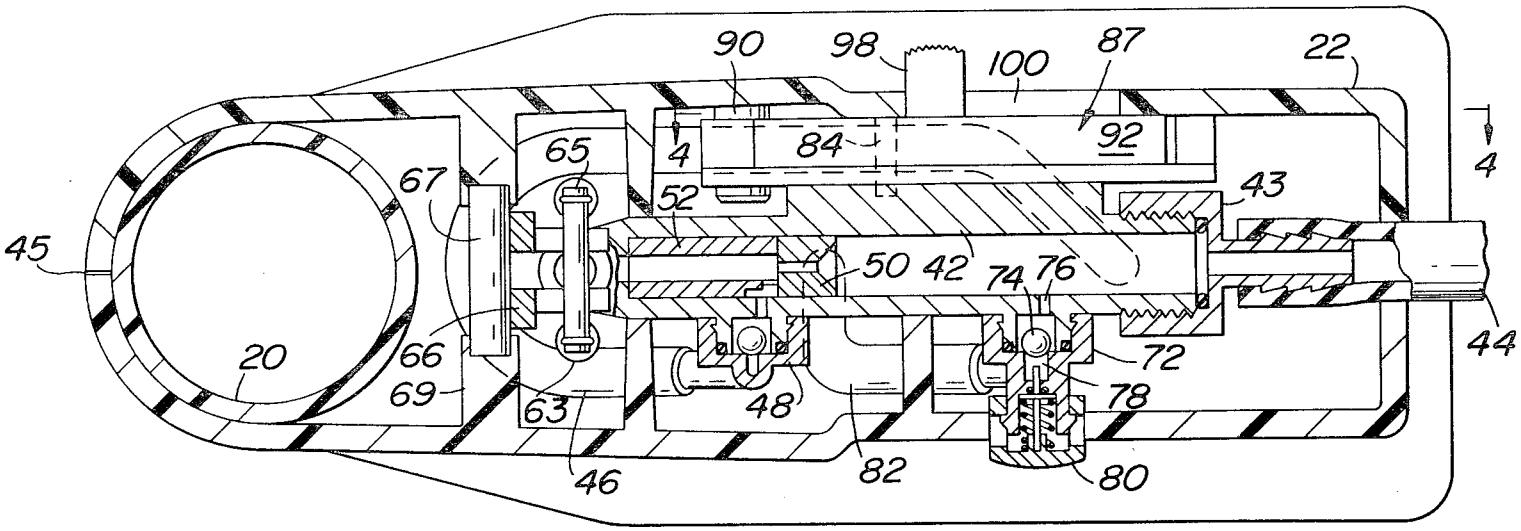
FIG. 3 is a sectional view taken along the line 3—3 in FIG. 2.

As shown more clearly in FIG. 2, the assembly 16 includes a housing 22. Housing 22 is preferably made of mating halves joined together along a vertical parting line. See FIG. 3. The mating halves of the housing 22 are attached to tube 20 by means of a fastener 24 which extends through the mating halves of the housing 22 and a boss on tube 20.

The assembly 16 includes a container 26 removably attached to the housing 22. Housing 22 includes a pivotably mounted latch 28 spring biased to the position shown in FIG. 2 by spring 30. The side of the container 26 remote from the latch 28 includes a lip 32 which overlies a flange 33 on the housing 22. The upper end of the container 26 engages a gasket 36 supported by the horizontally disposed wall 38 of housing 22. The container 26 may be removably attached to the housing 22 in any convenient manner other than that illustrated and described herein. The lower corner of the container 26 is preferably provided with a wall 40 angled at an acute angle with respect to the axis of tube 12. The container 26 is also preferably rectangular in section so that it may be attached to the housing 22 in only one position.

The housing 22 supports an inlet conduit 42 having one end attached to a flexible water supply hose 44 by way of adapter 43. Hose 44 extends through mating notches along the parting line 45 of the halves of the housing 22. The notches are preferably provided with a diameter slightly smaller than the outer diameter of hose 44 whereby the hose 44 is pinched slightly so as to remove any strain on the friction connection between the barbs on adapter 43 and hose 44.

A siphon tube 46 extends from a corner of the container 26 adjacent the lower end of angled wall 40 through the gasket 36 and wall 38 to barbs on a nipple 48 sealed to inlet conduit 42. See FIGS. 2 and 3. Within the nipple 48, there is provided a ball valve member which only permits flow from conduit 46 into conduit 42. Within the conduit 42 and upstream of the nipple 48, there is provided a restrictor 50. (See FIG. 3). Within conduit 42 and downstream from the nipple 48, there is provided a sleeve 52. As water flows through the conduit 42, it will siphon any mixture of water and detergent from the container 26 by way of siphon tube 46.

The left hand end of conduit 42 communicates with and may be integral with a valve body 54 at the inlet port 56. The valve body 54 at its lower end has an outlet port which communicates with one end of a conduit 58. The other end of conduit 58 is connected to a nozzle 60 supported by the head 14. See FIG. 1.

Valve member 62 is T-shaped with its vertical leg reciprocally supported within the valve body 54. Valve member 62 has a head 64 on its lower end for cooperating with a seat adjacent the outlet port. Springs 63 cooperate with the valve body 54 and the horizontal leg 65 of member 62 to bias valve member 62 to a closed position. Valve body 54 at its upper end is provided with a pivot pin 67 on which is pivotably mounted actuator 66. The ends of pin 67 are supported by bosses 69 on the halves of housing 22. See FIG. 3. Actuator 66 has a portion which extends through an opening 68 in the housing 22 and a portion which extends under the horizontal leg 65 of member 62. Hence, springs 63 bias actuator 66 to the position shown.

Valve member 62 is moved to an open position by pivoting the actuator 66 in the direction of arrow 70. Valve member 62 has an O-ring seal intermediate its ends so as to prevent any water from flowing upwardly toward the actuator 66 when the valve member is in its open position. When the valve member 62 is in its open position, a mixture of detergent and water flows from port 56 to the tube 58 for discharge from nozzle 60 onto the surface to be cleaned.

A valve body 72 is snapped onto a nipple on conduit 42 upstream from the restrictor 50. See FIG. 3. Within the valve body 72, there is provided a ball valve member 74 between the inlet port 76 and the outlet port 78. An actuator 80 is spring-biased to an inoperative position. When actuator 80 is pressed inwardly, it unseats the ball valve member 74 and permits flow of water from port 76 to port 78 which in turn is connected to one end of conduit 82. The other end of conduit 82 extends through the wall 38 of the housing 22 and communicates with the upper end of the container 26. When container 26 is initially attached to the housing 22, it is only partially filled with detergent. The remainder of container 22 is filled with water from conduit 42 by pressing inwardly on the actuator 80.

A transverse rib 84 is provided on the upper surface of wall 38. See FIGS. 2 and 3. A flow control device 87 is provided within the housing 22 for controlling flow of the detergent-water mixture through conduit 46 which is a flexible conduit passing over the rib 84 as shown more clearly in FIG. 3.

The flow control device 87 includes a member 88 pivotably connected to the housing 22 by a horizontally disposed pivot pin 90. See FIGS. 4 and 5. Member 88 includes an anvil 86 juxtaposed to the rib 84. Device 87 includes an actuator 92 supported by member 88 and slidable in a horizontal direction. The actuator 92 includes a cam surface 94 adapted to cooperate with a cam surface 96 on member 88. Actuator 92 includes a projection 98 extending through an opening 100 in the housing 22.

When the actuator 92 is manipulated by finger contact to the position shown in FIG. 4 by pressing on the projection 98, a mixture of water and detergent may flow through conduit 46 to the conduit 42. When projection 98 is manipulated to the position shown in FIG. 5, cam surface 94 contacts cam surface 96 and pivots member 88 about pin 90. As shown in FIG. 5, the anvil 86 cooperates with the rib 84 to deform the conduit 46 therebetween and shut off flow. In this manner, it is possible to selectively only discharge water through nozzle 60 or discharge a mixture of water and detergent through nozzle 60. In either event, the valve member 62 is manipulated in the same manner.

Figure 6:
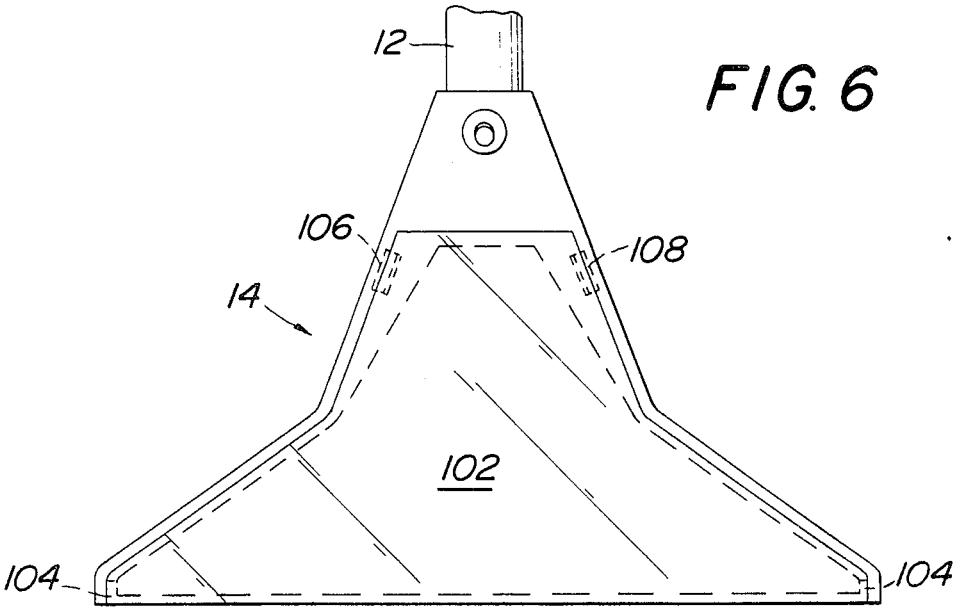
FIG. 6 is a front elevation view of the head at the lower end of the vacuum tube.
Figure 7:
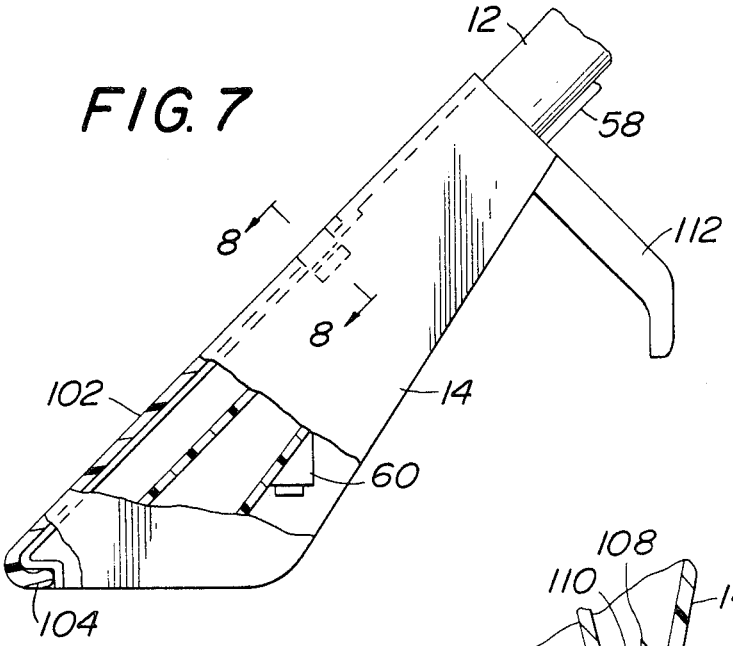
FIG. 7 is a side view of the head.
Figure 8:
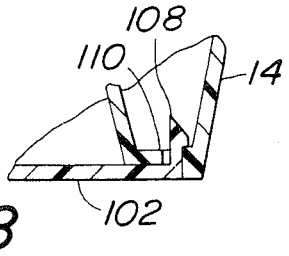
FIG. 8 is a sectional view taken along the line 8—8 in FIG. 7.

Head 14 includes a removable transparent plastic plate 102. The lower end of plate 102 is curved and has two blade like projections 104 which extend into recesses at the front end of the head 14. See FIGS. 6 & 7. The upper end of plate 102 has a pair of identical latches 106, 108 accessible from the rear of head 14. As shown in FIG. 8, latch 108 extends through a hole 110 and engages a shoulder on the head 14. To remove the plate 102 it is only necessary to squeeze the latches 106, 108 toward each other and push forwardly. To replace plate 102, the projections 104 are inserted into the recesses, and pressure is applied to snap latches 106, 108 in place.

Head 14 is preferably provided with a hook 112.

Housing 22 has a channel 114 on its upper surface. Channel 114 and hook 112 facilitate wrapping conduit 44 therearound for storage.

The present invention may be embodied in other specific forms without departing from the spirit or essential attributes thereof, and, accordingly, reference should be made to the appended claims, rather than to the foregoing specification, as indicating the scope of the invention.

I claim:

1. Wet-dry vacuum cleaning apparatus comprising a hollow vacuum tube having a head at one end, a discharge nozzle supported by said head, an assembly attached to said tube, said assembly including a valve having an inlet conduit and a container, an outlet on said valve being connected to said nozzle, means for causing liquid to flow into said inlet conduit from said container for mixing with water upstream of said valve, and means for selectively permitting water to flow from said conduit into said container while said container is supported by said assembly.

2. Apparatus in accordance with claim 1 including valve means independent of said first mentioned valve for selectively controlling flow from said container to said inlet conduit.

3. Apparatus in accordance with claim 1 including a removable transparent or translucent face plate on said head, said face plate being coupled to said head with a snap-on connection so that it may be readily removed for cleaning and then replaced.

4. Wet-dry vacuum cleaning apparatus comprising a hollow vacuum tube having a head at one end, a discharge nozzle supported by said head, an assembly attached to said tube, said assembly including a valve having an inlet conduit and a container, said valve having an outlet connected to said nozzle, means for causing liquid to flow into said inlet conduit from said container for mixing with water upstream of said valve, a removable face plate on said head, said face plate being transparent and coupled to said head with a snap-on connection.

5. Apparatus in accordance with claim 4 including means for selectively permitting water to flow from said inlet conduit into said container while the container is supported by a said assembly, and valve means for selectively controlling flow from said container to said inlet conduit so that said valve and valve means may cooperate to selectively control flow of water to said nozzle and flow of water and a liquid from said container to said nozzle.

6. Apparatus in accordance with claim 5 wherein said container communicates with said inlet conduit by way of a conduit made from flexible deformable material, said valve means being adapted to control flow through said last-mentioned conduit by deforming the same.

7. Apparatus in accordance with claim 4 wherein said container is rectangular and removably attached to said assembly adjacent the upper end of the container, the lower end of the container having an angled wall forming an acute angle with the longitudinal axis of said vacuum tube.

8. Wet-dry vacuum cleaning apparatus comprising a hollow vacuum tube having a head at one end, a discharge nozzle supported by said head, a split housing embracing a portion of said tube remote from said head, said housing having a valve therein, said valve having an inlet conduit within said housing, a container removably attached to a lower end portion of said housing, an outlet of said valve connected to said nozzle, an actuator for said valve, said actuator being supported by said housing and spring biased to a position corresponding to a closed position of said valve, means for selectively causing liquid to siphon into said inlet conduit from said container for mixing with water upstream of said valve as a result of water flowing through said valve.

9. Apparatus in accordance with claim 8 including a removable transparent or translucent face plate on said head, said face plate being coupled to said head with a snap-on connection so that it may be readily removed for cleaning and then replaced.

10. Apparatus in accordance with claim 9 including means in said housing for selectively permitting water to flow from said inlet conduit into said container while the container is supported by a said assembly.

11. Apparatus in accordance with claim 10 wherein said container is rectangular in section and removably attached to said housing adjacent the upper end of the container, the lower end of the container having an angled wall forming an acute angle with the longitudinal axis of said vacuum tube.

12. Apparatus in accordance with claim 8 where said housing is split along a parting line, said inlet conduit being aligned with said parting line and terminating in an adapter at one end remote from said valve for connecting a hose to said inlet conduit.

* * * * *